US012780495B2

(12) United States Patent
Lee et al.

(10) Patent No.: US 12,780,495 B2
(45) Date of Patent: Nov. 3, 2026

(54) MECHANICAL LOCKING PALLET

(71) Applicant: BATTELLE SAVANNAH RIVER ALLIANCE, LLC, Aiken, SC (US)

(72) Inventors: Thomas J. Lee, Sylvania, GA (US); Corey R. Hopper, North Augusta, SC (US)

(73) Assignee: Battelle Savannah River Alliance, LLC, Aiken, SC (US)

( * ) Notice: Subject to any disclaimer, the term of this patent is extended or adjusted under 35 U.S.C. 154(b) by 94 days.

(21) Appl. No.: 18/741,913

(22) Filed: Jun. 13, 2024

(65) Prior Publication Data

US 2024/0417136 A1 Dec. 19, 2024

Related U.S. Application Data

(60) Provisional application No. 63/507,758, filed on Jun. 13, 2023.

(51) Int. Cl.
*B65D 19/44* (2006.01)

(52) U.S. Cl.
CPC .... *B65D 19/44* (2013.01); *B65D 2519/00815* (2013.01)

(58) Field of Classification Search
CPC ..... B65D 19/38; B65D 19/44; B65D 90/004; B65D 90/006; B65D 2519/00766;
(Continued)

(56) References Cited

U.S. PATENT DOCUMENTS 5,297,485 A * 3/1994 Bond ..... B65D 19/44 108/54.1
5,722,330 A * 3/1998 Staggers ..... F16B 2/12 108/55.3

(Continued)

FOREIGN PATENT DOCUMENTS

AU 2016100760 A4 6/2016
CN 211520184 U 9/2020

(Continued)

OTHER PUBLICATIONS

Wee Pallet, "How to Choose a Drum Plastic Pallet for Overseas Shipping", Retrieved on Apr. 11, 2023 from https://www.wecpallet.com/drum-plastic-pallet-for-oversea-shipping/.

*Primary Examiner* — Daniel J Troy
*Assistant Examiner* — Elizabeth Irene Artalejo
(74) *Attorney, Agent, or Firm* — Dority & Manning, P.A.

(57) ABSTRACT

In one aspect, a pallet includes a plate configured to support a pallet object relative to a support surface and a capture assembly supported relative to the plate. The capture assembly is configured to selectively engage and disengage the pallet object and includes one or more capture bars movable between an unlocked position and a locked position. Each capture bar of the one or more capture bars is configured to be engaged with a portion of the pallet object when in the locked position and disengaged from said portion of the pallet object when in the unlocked position. Additionally, each capture bar of the one or more capture bars is configured to be actuated to the unlocked position with movement of the pallet towards the support surface and actuated to the locked position with movement of the pallet away from the support surface.

24 Claims, 11 Drawing Sheets

(58) Field of Classification Search
CPC ..... B65D 2519/00786; B65D 2519/00796; B65D 2519/0081; B65D 2519/00815; F16M 13/02; B60P 7/08; B60P 7/0892
USPC ..... 108/57.13, 57.16, 55.1, 55.3; 248/346.02, 346.03, 346.04; 206/477, 206/483, 486, 386, 596, 598, 600; 410/123
See application file for complete search history.

(56) References Cited

U.S. PATENT DOCUMENTS

| | | | | |
|---|---|---|---|---|
| 6,565,299 | B1 * | 5/2003 | Guilbault | B60P 7/13 410/1 |
| 8,028,631 | B2 * | 10/2011 | Lauzier | B65D 19/0002 108/55.3 |
| 8,459,911 | B1 | 6/2013 | Kim et al. | |
| 8,876,069 | B2 * | 11/2014 | Cimaglio | B01F 35/422 248/346.03 |
| 10,065,780 | B1 | 9/2018 | Jain | |
| 10,532,854 | B2 | 1/2020 | Jain | |
| 12,187,489 | B2 * | 1/2025 | Zou | B25J 11/00 |
| 2002/0108540 | A1 * | 8/2002 | Underbrink | B65D 19/44 108/55.3 |
| 2014/0079516 | A1 * | 3/2014 | Chen | B65G 1/02 248/346.04 |
| 2020/0407110 | A1 * | 12/2020 | Vaeth | B65D 19/12 |
| 2023/0065396 | A1 * | 3/2023 | Mothersbaugh | B25B 11/00 |

FOREIGN PATENT DOCUMENTS

| | | | |
|---|---|---|---|
| CN | 218022760 | U | 12/2022 |
| DE | 40 19 267 | A1 | 12/1991 |
| JP | 2023005218 | A | 1/2023 |
| KR | 10-2350189 | B1 | 1/2022 |

* cited by examiner

MECHANICAL LOCKING PALLET

CROSS-REFERENCE TO RELATED APPLICATIONS

This present application is based upon and claims the right of priority to U.S. Provisional Patent Application No. 63/507,758, filed Jun. 13, 2023, the disclosure of which is hereby incorporated by reference herein in its entirety for all purposes.

FEDERAL RESEARCH STATEMENT

This invention was made with government support under Contract No. 89303321 CEM000080 awarded by the U.S. Department of Energy. The government has certain rights in the invention.

FIELD

This present subject matter relates generally to a mechanical locking pallet, more particularly, to a mechanical locking pallet for the transportation of objects, such as cylinders.

BACKGROUND

Traditionally, pallets have been utilized to transport or carry various objects and equipment. For instance, a pallet may be used to transport objects, such as cylinders (e.g., drums, barrels, canisters). In general, after an object is positioned on a pallet, the object is wrapped and/or banded with a material, such as plastic wrapping and/or plastic bands. The wrapping and/or bands are generally utilized to prevent or minimize the movement of the object positioned on a pallet. However, the wrapping and/or banding may be subject to human error in the application thereof, may require excessive handling time by operators or employees, may utilize expensive equipment in the application of the wrapping or banding, and may expose operators, employees, and more generally the manufacturing environment, to the hazardous contents contained within the object positioned on the pallet.

Thus, there is a need for an improved mechanical pallet and related method for the locking or engagement of one or more objects positioned on the pallet.

SUMMARY OF THE INVENTION

Aspects and advantages of the invention will be set forth in part in the following description, or may be obvious from the description, or may be learned through practice of the invention.

In one aspect, the present subject matter is directed to a pallet. The pallet includes a plate configured to support a pallet object relative to a support surface and a capture assembly supported relative to the plate. The capture assembly is configured to selectively engage and disengage the pallet object and includes one or more capture bars movable between an unlocked position and a locked position. Each capture bar of the one or more capture bars is configured to be engaged with a portion of the pallet object when in the locked position and disengaged from said portion of the pallet object when in the unlocked position. Additionally, each capture bar of the one or more capture bars is configured to be actuated to the unlocked position with movement of the pallet towards the support surface and actuated to the locked position with movement of the pallet away from the support surface.

In another aspect, the pallet includes first and second capture bars, with the first and second capture bars configured to be engaged with separate portions of an outer perimeter of the pallet object when in the locked position. In one embodiment, the first and second capture bars are configured to engage the pallet object along opposed sides of the pallet object. In another embodiment, the first and second capture bars are configured to engage the pallet object along a same side of the pallet object.

In a further aspect, the pallet further includes a linkage assembly provided in operative association with the capture assembly, with the linkage assembly being configured to actuate each capture bar of the one or more capture bars to the unlocked position with movement of the pallet towards the support surface.

In one aspect, a portion of the linkage assembly is configured to contact the support surface or a member supported relative to the support surface as the pallet is moved towards the support surface such that the contact results in each capture bar of the one or more capture bars being actuated to the unlocked position.

In another aspect, the portion of the linkage assembly comprises a standoff configured to contact the support surface or the member supported relative to the support surface. The standoff is coupled to each capture bar of the one or more capture bars via one or more components of the linkage assembly such that movement of the standoff relative to the plate of the pallet results in each capture bar of the one or more capture bars being actuated to the unlocked position.

In a further aspect, a biasing member is provided in operative association with the standoff. The biasing member is configured to apply a biasing force against the standoff that biases each capture bar of the one or more capture bars towards the unlocked position.

In yet another aspect, upward movement of the standoff relative to the plate results in each capture bar of the one or more capture bars being actuated to the unlocked position, with the biasing member being configured to apply a downwardly directed basing force against the standoff.

In one aspect, a biasing device is provided in operative association with the capture assembly separate from the linkage assembly, the biasing device being configured to bias each capture bar of the one or more capture bars towards the locked position.

In another aspect, a biasing device is coupled to each capture bar of the one or more capture bars, with the biasing device being configured to bias each capture bar of the one or more capture bars towards the locked position.

In a further aspect, the pallet further includes a lock assembly configured to engage a portion of the capture assembly to maintain each capture bar of the one or more capture bars in the locked position.

In another aspect, the lock assembly comprises a lock mechanism configured to be moved relative to each capture bar of the one or more capture bars between an engaged state and a disengaged state.

In yet another aspect, the lock mechanism is configured to be moved toward the disengaged state with movement of the pallet towards the support surface and moved towards the engaged state with movement of the pallet away from the support surface.

In one aspect, the present subject matter, is directed to a method for securing pallet objects relative to a pallet. The pallet includes a plate configured to support a pallet object relative to a support surface. The pallet further includes a capture assembly supported relative to the plate that is configured to selectively engage and disengage the pallet object. The capture assembly includes one or more capture bars movable between an unlocked position and a locked position. The method includes positioning the pallet object onto the plate relative to the capture assembly while the pallet is supported by the support surface and one or more the capture bars are in the unlocked position and raising the pallet relative to the support surface such that the capture bars are moved to the locked position and engage with a portion of the pallet object.

In another aspect, the method includes, subsequent to raising the pallet relative to the support surface, lowering the pallet relative to the support surface such that the one or more capture bars are moved to the unlocked position and disengage with the portion of the pallet object.

In a further aspect, the pallet further includes a linkage assembly provided in operative association with the capture assembly, with a portion of the linkage assembly being configured to contact the support surface or a member supported relative to the support surface when the pallet is supported by the support surface. In one embodiment, lowering the pallet relative to the support surface comprises lowering the pallet relative to the support surface such that the portion of the linkage assembly contacts the support surface or the member supported relative to the support surface such that the linkage assembly actuates the one or more capture bars to the unlocked position.

In yet another aspect, the pallet further includes a biasing device provided in operative association with the capture assembly separate from the linkage assembly, with the biasing device being configured to bias the one or more capture bars towards the locked position. In one embodiment, raising the pallet relative to the support surface comprises raising the pallet relative to the support surface such that the portion of the linkage assembly no longer contacts the support surface or the member supported relative to the support surface and the biasing device biases the one or more capture bars into the locked position.

In another aspect, one or more capture bars comprises first and second capture bars. In one embodiment, positioning the pallet object onto the plate relative to the capture assembly comprises positioning the pallet object into the plate such that the first and second capture bars are positioned along opposed sides of an outer perimeter of the pallet object, with the capture bars being configured to engage separate portions of the outer perimeter of the pallet object when moved to the locked position.

In a further aspect, the pallet further includes a lock assembly configured to engage a portion of the capture assembly to maintain the one or more capture bars in the locked position. In one embodiment, raising the pallet relative to the support surface further comprises raising the pallet relative to the support surface such that a lock mechanism of the lock assembly is moved to an engage state with the one or more capture bars to maintain the one or more capture bars in the locked position.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
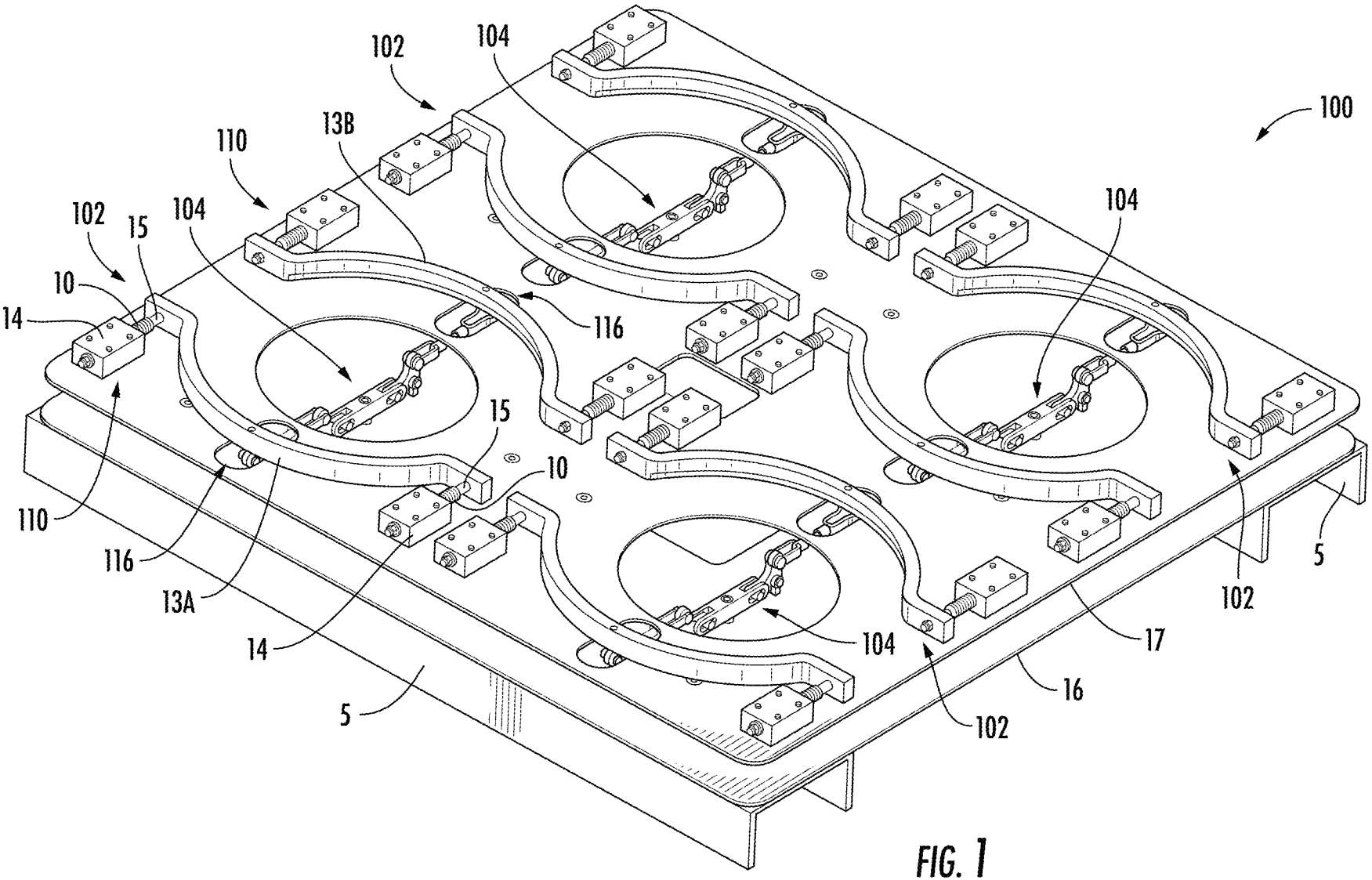
FIG. 1 illustrates a perspective view of one embodiment of a mechanical pallet in accordance with aspects of the present subject matter.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment may be used in another embodiment to yield a still further embodiment.

In general, the present disclosure is directed to a mechanical pallet and related methods for engaging one or more pallet objects. In one aspect, a pallet and related methods designed in accordance with the present disclosure may be configured to automatically engage or lock against one or more pallet objects, such as one or more cylindrical pallet objects (e.g., drums, barrels, canisters). In this respect, the pallet of the present disclosure may position and/or affix one or more pallet objects to a set position on the mechanical pallet. Notably, a pallet formed in accordance with the present disclosure may decrease or eliminate the utilization of the wrapping and/or banding of one or more pallet objects on a pallet. Further, a pallet formed in accordance with the present disclosure may decrease or eliminate human error in the application of wrapping and/or banding of one or more objects on a mechanical pallet. Additionally, a pallet formed in accordance with the present disclosure may decrease the handling time of operators or employees for securing, fixing, and/or locking one or more pallet objects to the pallet. Moreover, a pallet formed in accordance with the present disclosure may reduce or eliminate the utilization of wrapping equipment and/or banding equipment in the application of the wrapping and/or banding to one or more pallet objects on a mechanical pallet. Furthermore, a pallet formed in accordance with the present disclosure may reduce or eliminate the exposure of operators, employees, and more generally the manufacturing environment, to the hazardous contents contained within one or more pallet objects on the pallet.

Figure 2:
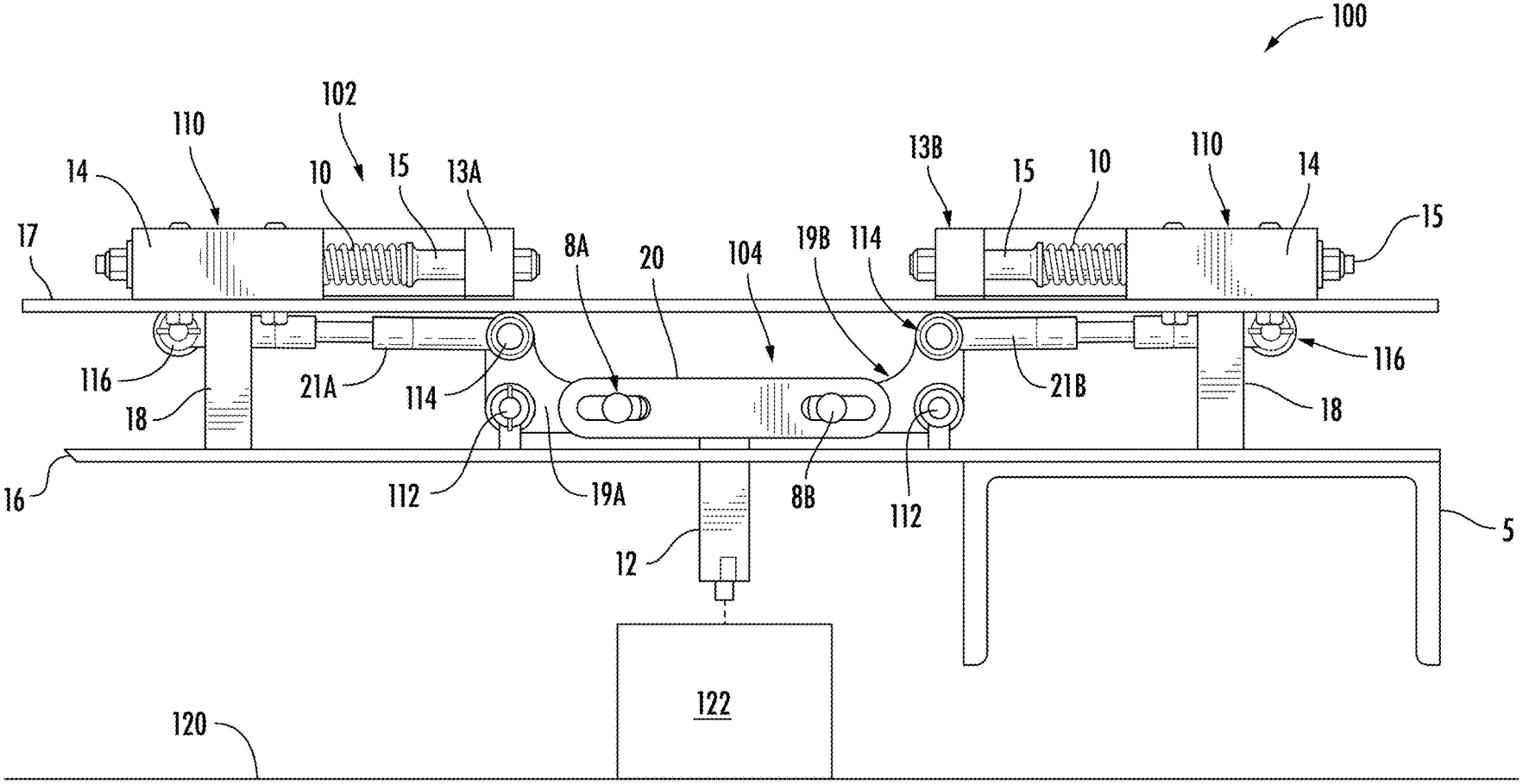
FIG. 2 illustrates a partial side view of the pallet shown in FIG. 1, particularly illustrating components of the pallet in a locked position in accordance with aspects of the present subject matter.
Figure 3:
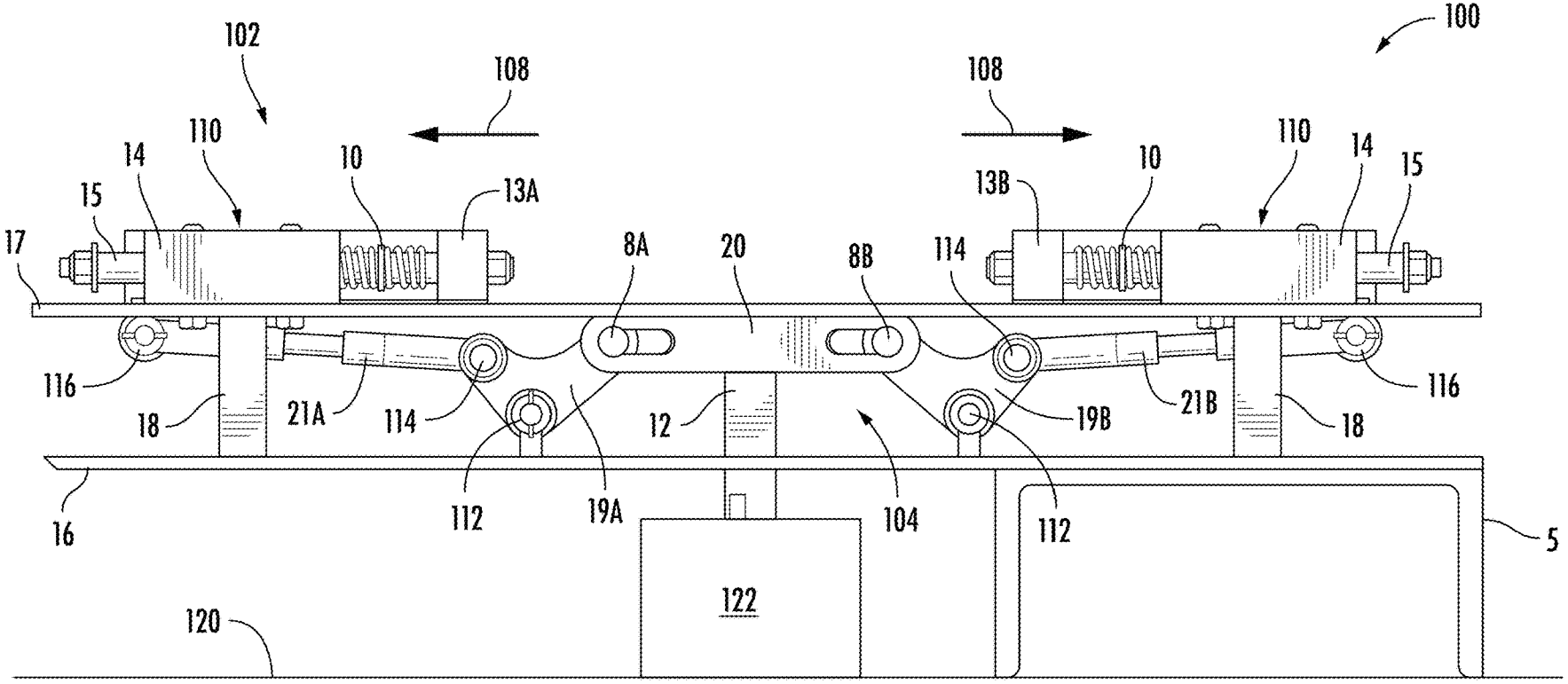
FIG. 3 illustrates another partial side view of the pallet shown in FIG. 1, particularly illustrating components of the pallet in an unlocked position in accordance with aspects of the present subject matter.

Referring now to the drawings, FIGS. 1-3 illustrate views of one embodiment of a pallet 100 in accordance with aspects of the present subject matter. Specifically, FIG. 1 illustrates a perspective view of the pallet 100. FIGS. 2 and 3 illustrate partial side views of the pallet 100 shown in FIG. 1, particularly illustrating components of the pallet 100 in a locked position (FIG. 2) and an unlocked position (FIG. 3).

As shown in FIGS. 1-3, the pallet 100 may generally include a bottom plate 16, a top plate 17, and a plurality of standoffs 18 (e.g., four top standoffs) extending between the bottom and top plates 16, 17 to support the top plate 17 relative to the bottom plate 16. The standoffs 18 may set a fixed distance or height between the bottom and top plates 16, 17. The pallet 100 may also include lift-brackets 5 extending from the bottom plate 16. As shown in the illustrated embodiment, the lift-brackets 5 may define upside-down U-shaped channels configured to receive components of a separate lifting mechanism for lifting the pallet 100, such as the forks of a forklift.

Additionally, as shown in FIGS. 1-3, the pallet 100 also includes a plurality of capture assemblies 102 and a corresponding number of linkage assemblies 104. Specifically, in the illustrated embodiment, the pallet 100 includes four capture assemblies 102 and four corresponding linkage assemblies 104 to allow four pallet objects 106 (FIG. 4) to be supported on top of and locked into place relative to the pallet 100. For instance, referring briefly to FIG. 4, the pallet 100 may be configured to support cylindrical objects (e.g., barrels, drums, canisters, etc.) or any other suitable pallet objects 106. It should be appreciated that, in other embodiments, the pallet 100 may be configured to include any other suitable number of capture assemblies 102 and associated linkage assemblies 104 to allow a corresponding number of pallet objects 106 to be supported on top of and locked into place relative to the pallet 100.

Figure 4:
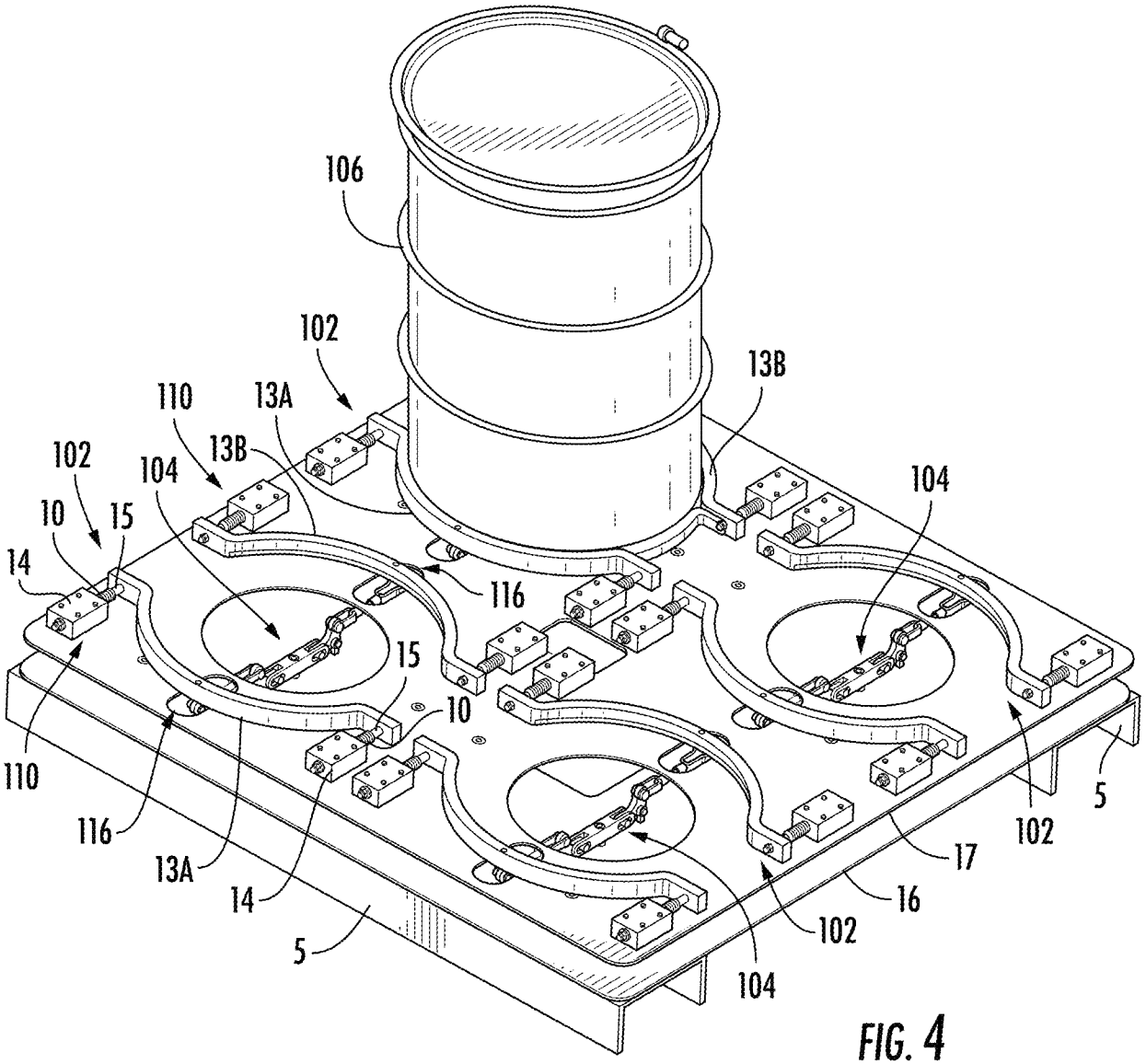
FIG. 4 illustrates another perspective view of the pallet shown in FIG. 1, particularly illustrating a pallet object supported on the pallet (e.g., on a top plate of the pallet)

Referring back to FIGS. 1-3, the capture assemblies 102 may be configured to capture or lock the supported pallet objects 106 in place relative to the top plate 17 of the pallet 100. As shown in FIGS. 1-3, each capture assembly 102 may generally include a pair of capture bars 13 (e.g., first and second capture bars 13A, 13B) configured to extend around and lock against an outer perimeter of the associated pallet object (e.g., object 106 of FIG. 4) being supported by the pallet 100. For instance, as particularly shown in FIG. 1, each capture bar 13 has a curved shape generally configured to match the radius of curvature of the pallet object 106, as shown in FIG. 4, thereby allowing the capture bars 13 to extend around and engage the outer perimeter of the pallet object 106. However, in other embodiments, the capture bars 13 may be configured to define any other suitable shape or profile depending on the shape or profile of the pallet object being supported by and locked relative to the pallet 100.

As will be described below, the capture bars 13 of each capture assembly 102 may be movable between a locked position and an unlocked position based on the corresponding position of the associated linkage assembly 104. For instance, as shown in FIG. 2, when the linkage assembly 104 is moved to the locked position, the capture bars 13 are similarly moved to a locked position at which the capture bars 13 are configured to engage and lock against the outer perimeter of the associated pallet object (e.g., as shown in FIG. 4). As shown in FIG. 3, when the linkage assembly 104 is moved to the unlocked position, the capture bars 13 are similarly moved to an unlocked position at which the bars are configured to be spaced apart and disengaged from the associated pallet object. For instance, when transitioning from the locked position to the unlocked position, the capture bars 13 may move away from the associated pallet object (and away from each other e.g., in the direction 108 of the arrows in FIG. 3) to allow the capture bars 13 to be disengaged from the outer perimeter of the pallet object and, thus, allow the object to be removed from the pallet 100. Similarly, when transitioning from the unlocked position to the locked position, the capture bars 13 may be moved in the opposite direction towards the pallet object (and towards each other) to allow the capture bars 13 to engage/lock against the outer perimeter of the object.

Additionally, as shown in the illustrated embodiment, each capture assembly 102 may also include one or more biasing devices 110 configured to bias the capture bars 13 into the closed or locked position. Specifically, in several embodiments, the biasing device(s) 110 may correspond to a spring-loaded or spring-applied biasing device. For instance, as particularly shown in the illustrated embodiment, each biasing device 110 may include a pair of capture blocks 14 mounted to the top of the top plate 17, with each capture block 14 being mounted to the top plate 17 adjacent to a respective end of an associated capture bar 13. Additionally, the biasing device 110 may include a pair of spring-loaded capture rods 15 (and associated springs 10), with each capture rod 15 being slidingly received within a corresponding capture block 14 and being coupled to the adjacent respective end of the capture bar 13. As such, each biasing device 110 may be configured to bias its respective capture bar 13 into the locked position. However, as the linkage assemblies 104 are moved from the locked position to the unlocked position, the springs 10 may be compressed to allow the capture bars 13 to be moved in the unlocking direction 108 towards the unlocked position (i.e., movement of the bars 13 against the bias of the biasing devices 110). As will be described below, the biasing force applied by the biasing device 110 may be configured to automatically move the capture bars 13 into the locked position when the pallet 100 is lifted from the ground to ensure that the pallet objects are maintained in place relative to the pallet 100.

It should be appreciated that, to simplify the drawings, the various components of each capture assembly 102 are only labeled for one of such capture assemblies 102 in FIG. 1 and the various components of each biasing device 110 are only labeled for one of such biasing devices 110 in FIG. 1.

Referring still to FIGS. 1-3, each linkage assembly 104 may generally include a plurality of connected or linked components positioned between the bottom and top plates 16, 17 that, when actuated, are configured to move the capture bars 13 from the locked position to the unlocked position. Specifically, as particularly shown in FIGS. 2 and 3, each linkage assembly 104 may include a bottom standoff 12 that extends vertically through the bottom plate 16 of the pallet 100. The bottom standoff 12 is coupled at its top end to a centralized transfer lever 20 of the linkage assembly 104. The transfer lever 20 is, in turn, coupled to a pair of transfer arms 19 (e.g., via respective sliding pin joints 8). Specifically, as shown in FIGS. 2 and 3, the transfer lever is coupled to a first transfer arm 19A via a first sliding pin joint 8A and a second transfer arm 19B via a second sliding pin joint 8B. Each transfer arm 19 is coupled to the bottom plate 16 via a bottom pivot joint 112 and to a respective transfer rod 21 of the linkage assembly 104 via a top pivot joint 114. For instance, the first transfer arm 19A is coupled to a first transfer rod 21A at its top pivot joint 114 and the second transfer arm 19B is coupled to a second transfer rod 21B at its top pivot joint 114. Each transfer rod 21 is, in turn, coupled to a respective capture bar 13 of the associated capture assembly 102. For instance, as shown in FIGS. 2 and 3, the first transfer rod 21A is coupled to a first capture bar 13A and the second transfer rod 21B is coupled to a second capture bar 13B. The location of two connection points 116 between a capture bar 13 and the associated transfer rod 21 is labeled in FIG. 1 for one of the capture/linkage assemblies 102/104.

Given such a configuration, when the bottom standoff 12 is actuated upwardly in the vertical direction (e.g., towards the top plate 17), the transfer lever 20 is similarly pushed or actuated upwardly (e.g., see the change in position of the transfer lever 20 from FIG. 2 to FIG. 3). Such upward movement of the transfer lever 20 results in the transfer arms 19 pivoting about their respective bottom pivot joints 112, which, in turn, actuates the transfer rods 21 outwardly in the unlocking direction 108 (FIG. 3). Since the transfer rods 21 are coupled to the capture bars 13, such outward actuation of the transfer rods 21 results in the capture bars 13 similarly being actuated in the unlocking direction 108 to their unlocked position. As indicated above, at such unlocked position, the capture bars 13 may be disengaged from the associated pallet object, thereby allowing the object to be removed from the pallet 100 if desired.

It should be appreciated that such upward actuation of the bottom standoff 12 of each linkage assembly 104 may, in several embodiments, be initiated as the pallet is lowered down onto a support surface 120 (e.g., the floor). Specifically, in one embodiment, the pallet 100 may be configured to be lowered onto blocks or other support members 122 positioned on the support surface 120 such that, as the pallet 100 is lowered, the bottom end of each bottom standoff 12 contacts a respective support member 122, thereby causing the bottom standoff 12 to be actuated upwardly relative to the fixed plates 16, 17 of the pallet 100 to initiate movement of the linkage assembly 104. Alternatively, in instances in which the height or length of each bottom standoff 12 is such that the bottom standoffs 112 extend vertically below the bottom ends of the lift-brackets 5, the contact between the bottom end of each bottom standoff 12 and the support surface 120, itself, may result in the bottom standoffs 12 being actuated upwardly to initiate movement of the linkage assembly 104.

Similarly, when the pallet 100 is lifted off the support surface 120 (or support members 122) such that the upward force on each bottom standoff 12 is removed, the biasing force applied by the biasing devices 110 may function to actuate the capture bars 13 and associated linkage assemblies 104 back to the locked position. Specifically, the biasing force applied by each biasing device 110 against its respective capture bar 13 may force the capture bar 13 (and the transfer rod 21 coupled thereto) in the locking direction, thereby causing the transfer arms 19 to pivot about their respective bottom pivot joints 112 in the opposite direction, which, in turn, forces the transfer lever 20 downwardly to return the linkage assembly to the locked position. As such, by lifting the pallet 100 relative to the support surface 120, the capture assemblies 102 may be configured to automatically transition to the locked state to engage any pallet objects being supported on the pallet 100, thereby securing the objects on the pallet 100. Similarly, by lowering the pallet 100 onto the support surface 120 (or support members 122), the capture assemblies 102 may be automatically actuated to the unlocked state to release any pallet objects being supported on the pallet 100, thereby allowing the objects to be removed therefrom.

Figure 5:
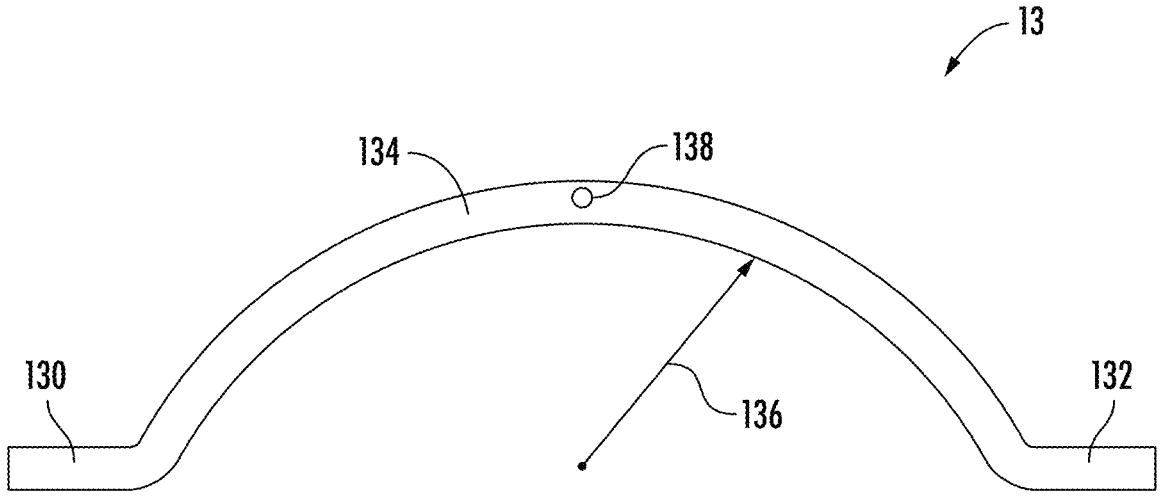
FIG. 5 illustrates a top view of one embodiment of a capture bar suitable for use with a pallet in accordance with aspects of the present subject matter.

Referring now to FIG. 5, a top view of one of the capture bars 13 described above with reference to FIGS. 1-4 is illustrated in accordance with aspects of the present subject matter. As shown in FIG. 5 the capture bar 13 generally includes first and second end sections 130, 132 and a clamping section 134 extending between the end sections 130, 132. In general, the end sections 130, 132 of the capture bar 13 may be configured to be coupled to corresponding components of the respective biasing device 110 of the associated capture assembly 102. For instance, as indicated above, each biasing device 110 may include a pair of capture blocks and a pair of spring-loaded capture rods 15 (and associated springs 10), with each capture rod 15 being slidingly received within a corresponding capture block 14. In such an embodiment, each capture rod 15 may be coupled to secure to one of the end sections 130, 132 of the capture bar 13, thereby allowing the spring-loaded to capture rods 15 to actuate the capture bar 13 in the locking direction 108 when the pallet 100 is being lifted from the ground.

The clamping section 134 of the capture bar 13 may generally be configured to define a profile between the opposed end sections 130, 132 of the bar 13 that matches (or is complementary to) the profile of the outer perimeter of the pallet object intended to be secured to the pallet 100. For instance, in the illustrated embodiment, the clamping section 134 defines a curved profile between the opposed end sections 130, 132 of the bar 13 (e.g., a semi-circular shape/profile between the end sections 130, 132) In such an embodiment, the curved profile may generally, for instance, be selected to match (or be complementary to) the curved profile of a cylindrical pallet object intended to be secured to the pallet 100 (e.g., object 106 shown in FIG. 4), such as by configuring the clamping section 134 to define a radius of curvature that generally matches (or is complementary to) the radius of curvature pallet object. However, in other embodiments, the clamping section 134 may be configured to define any other profile or shape that allows it to clamp around and/or otherwise engage a corresponding pallet object when the capture bar 13 is moved to the locked position around the outer perimeter of the object.

As indicated above, each capture bar 13 may be configured to be coupled to a transfer rod 21 of the respective linkage assembly 104, thereby allowing the capture bar 13 to be actuated into the unlocked position with actuation of the transfer rod 21. In this regard, the capture bar 13 may include one or more features for coupling the transfer rod 21 thereto. For instance, in the illustrated embodiment, the capture bar 13 includes a fastener opening defined through a portion of the clamping section 134 (e.g., at the center of the clamping section 134) to allow the capture bar 13 to be coupled to the adjacent transfer rod 21. Although not shown, it should be appreciated that the capture bar 13 may similarly include one or more features for coupling each capture rod 15 to the respective end section 130, 132, such as one or more fastener openings.

Figure 6:
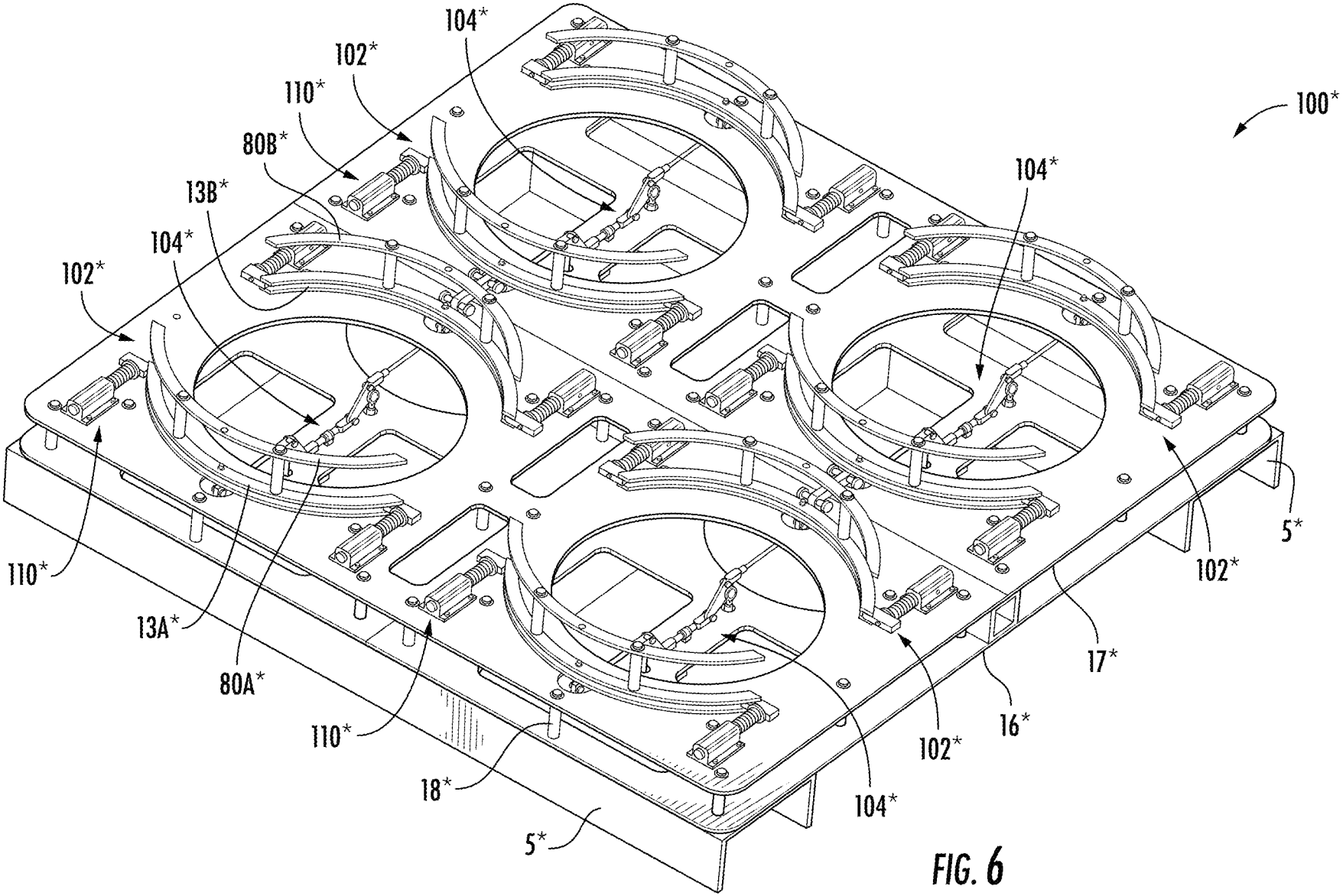
FIG. 6 illustrates a perspective view of another embodiment of a mechanical pallet in accordance with aspects of the present subject matter.
Figure 7:
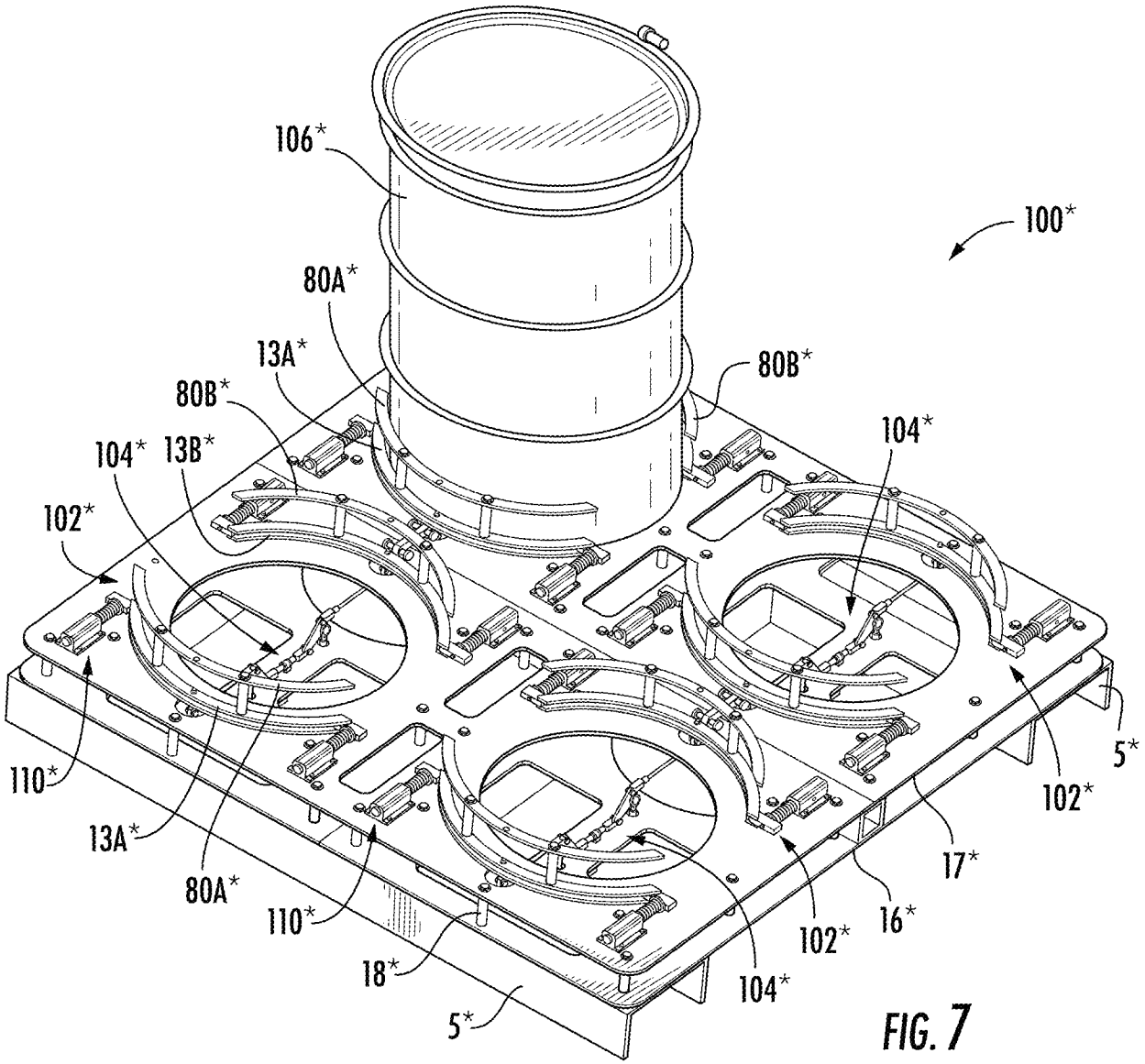
FIG. 7 illustrates another perspective view of the pallet shown in FIG. 6, particularly illustrating a pallet object supported on the pallet (e.g., on a top plate of the pallet)
Figure 8:
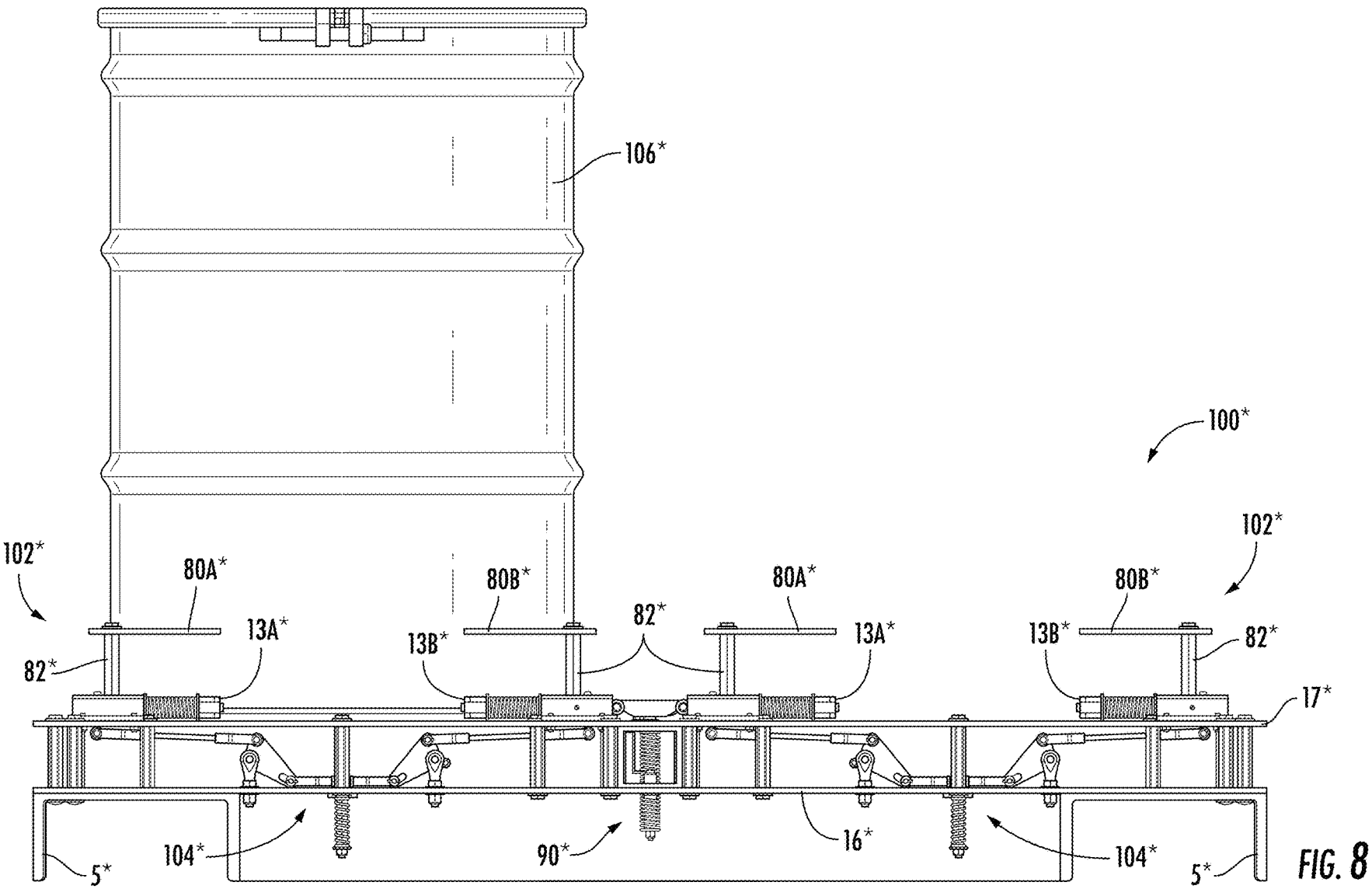
FIG. 8 illustrates a side view of the pallet and pallet object shown in FIG. 7.
Figure 9:
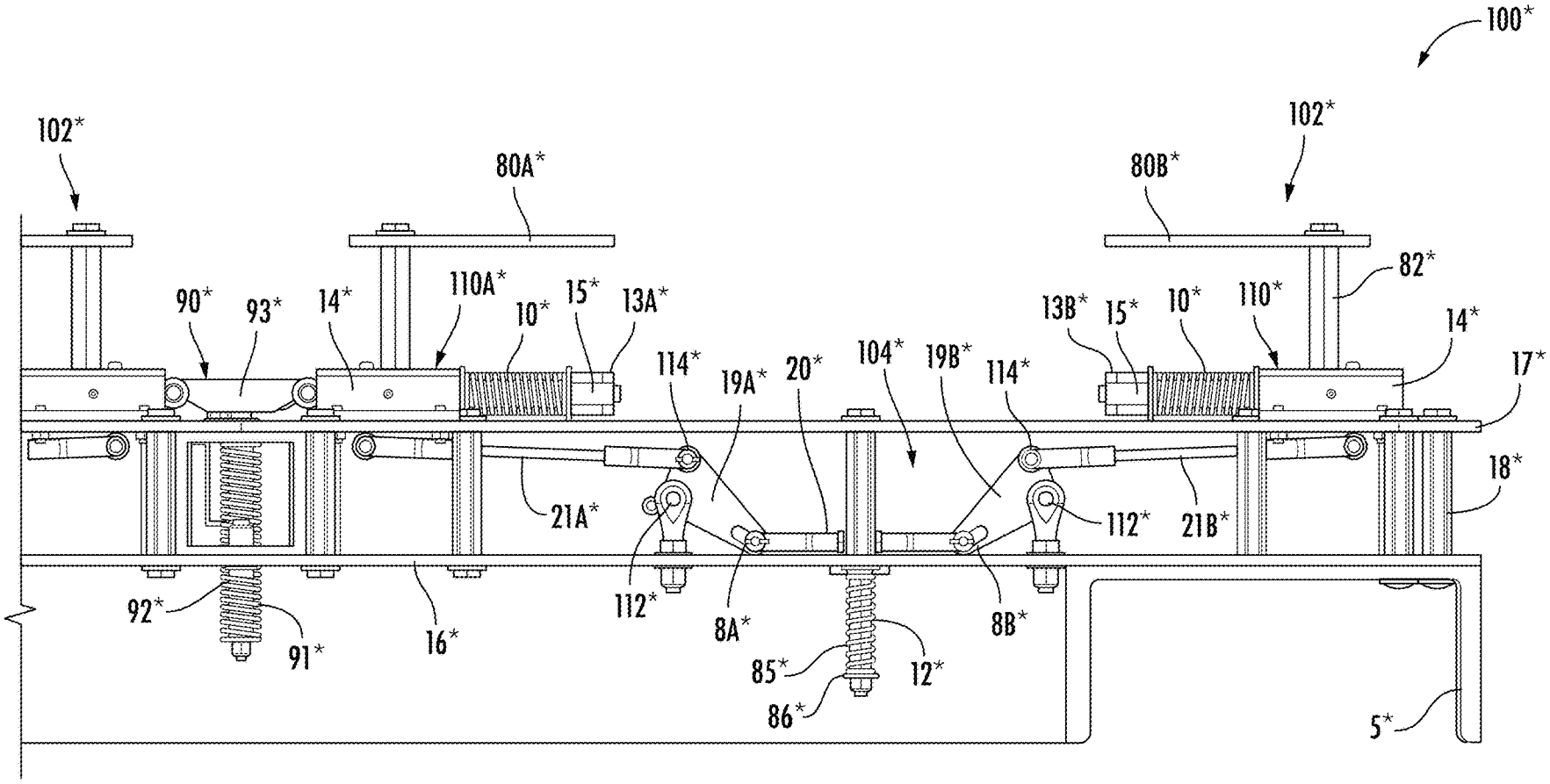
FIG. 9 illustrates a side view of a portion of the pallet shown in FIG. 8 with the pallet object being removed for purposes of illustration.

Referring now to FIGS. 6-9, various views of an alternative embodiment of a pallet 100* are illustrated in accordance with aspects of the present subject matter. Specifically, FIG. 6 illustrates a perspective view of the pallet 100* and FIG. 7 illustrates the same perspective view of the pallet 100* shown in FIG. 6 with a pallet object 106* positioned (and supported) thereon. Additionally, FIG. 8 illustrates a side view of the pallet 100* and pallet object 106* shown in FIG. 7, while FIG. 9 illustrates a portion of the side view of the pallet 100* shown in FIG. 8 with the pallet object 106* being removed for purposes of illustration. In general, the pallet 100* shown in FIGS. 6-9 is generally configured the same as or similar to the pallet 100 described above with reference to FIGS. 1-5. As such, features and/or structures of the pallet 100* that are the same or similar to corresponding features and/or structures of the pallet 100 described above will be designated by the same reference character with an asterisk (*) added. Additionally, when a given feature and/or structure of the pallet 100* is configured to generally perform the same function as the corresponding feature and/or structure of the pallet 100* described above, a less detailed description of such feature/structure will be provided below for the sake of brevity.

As shown in FIGS. 6-9, the pallet 100* may generally include a bottom plate 16*, a top plate 17*, and a plurality of standoffs 18* extending between the bottom and top plates 16*, 17* to support the top plate 17* relative to the bottom plate 16*. Additionally, similar to the embodiment described above, the pallet 100* may also include lift-brackets 5* extending from the bottom plate 16* that are configured to receive components of a separate lifting mechanism for lifting the pallet 100*, such as the forks of a forklift.

Additionally, as shown in FIGS. 6-9, the pallet 100* also includes a plurality of capture assemblies 102* and a corresponding number of linkage assemblies 104*. In general, the capture assemblies 102* may be configured the same or similar as the capture assemblies 102 described above. For instance, each capture assembly 102* may generally include a pair of capture bars 13* (e.g., first and second capture bars 13A,* 13B*) configured to extend around and lock against an outer perimeter of the associated pallet object (e.g., object 106*) being supported by the pallet 100, with the capture bars 13* being movable between a locked position and an unlocked position based on the corresponding position of the associated linkage assembly 104*. Moreover, each capture assembly 102* may also include one or more biasing devices 110* configured to bias the capture bars 13* into the closed or locked position. Similar to the embodiment described above, each biasing device 110* may correspond to a spring-loaded or spring-applied biasing device. For instance, each biasing device 110* may include a pair of capture blocks 14* mounted to the top of the top plate 17* and a pair of spring-loaded capture rods 15* (and associated springs 10*), with each capture rod 15* being slidingly received within a corresponding capture block 14* and being coupled to an adjacent respective end section of the capture bar 13* (e.g., end sections 130, 132 shown in FIG. 5).

However, unlike the embodiment of the pallet 100 described above with reference to FIGS. 1-5, each capture assembly 102* further includes one or more auxiliary or upper capture bars 80* configured to extend around and lock against the outer perimeter of the associated pallet object 106*. Specifically, as shown in FIGS. 6-9, each capture assembly 102* additionally includes a pair of upper capture bars 80* (e.g., a first upper capture bar 80A* and a second upper capture bar 80B*), with each auxiliary capture bars 80* being supported relative to a respective primary or "lower" capture bar 13* of the capture assembly 102* along each side of the pallet object 106*. For instance, as particularly shown in FIG. 9, one or more vertically extending connector bars 82* may be installed or extend between the upper and lower capture bars 80*, 13* to allow the upper capture bars 80* to be supported vertically above (and relative to) the lower capture bars 13*. As such, w the upper capture bars 80* may be configured to move together with the lower capture bars 13* between the locked and unlocked positions, thereby allowing the respective pairs of upper and lower capture bars 80*, 13* to simultaneously engage the outer perimeter of the pallet object 106* along each side of the pallet object 106* when being moved to the locked position and simultaneously disengage the outer perimeter of the pallet object 106* when being moved to the unlocked position.

It should be appreciated that the upper capture bars 80* may be configured similarly to the lower capture bars 13*. For instance, the upper capture bars 80* may define a profile or shape that matches or is generally complementary to the outer profile or shape of the pallet object 106*. Specifically, in the illustrated embodiment, the upper capture bars 80* define a curved profile (e.g., the same or similar curved profile as the lower capture bars 13*) that generally matches or is complementary to the cylindrical shape of the pallet object 106*, thereby allowing each capture bar 80* to securely engage the outer perimeter of the pallet object 106* when moved to the locked position.

It should be appreciated that the addition of the upper capture bars 80* may provide increased vertical stability to the pallet 100*, particularly in relation to the engagement with the pallet object 106*. In particular, by providing an additional set of capture bars that engage the pallet object 106* at a separate, higher location, the potential for the pallet object 106* tipping-over (particularly a top-heavy object) may be reduced significantly.

Referring still to FIGS. 6-9, similar to the embodiment of the linkage assembly 104 described above, each linkage assembly 104* may generally include a plurality of connected or linked components positioned between the bottom and top plates 16*, 17* that, when actuated, are configured to move the capture bars 13* (including the upper capture bars 80* coupled thereto) from the locked position to the unlocked position. For instance, as particularly shown in FIG. 9, each linkage assembly 104* may include a bottom standoff 12* and centralized transfer lever 20* coupled to the top end of the bottom standoff 12*, with the transfer lever 20* being, in turn, coupled to a pair of transfer arms via sliding pin joints (e.g., a first transfer arm 19A* via a first sliding pin joint 8A* and a second transfer arm 19B* via a second sliding pin joint 8B*). Similar to the embodiment described above with reference to FIGS. 2 and 3, each transfer arm 19A*, 19B* is coupled to the bottom plate 16* via a bottom pivot joint 112* and to a respective transfer rod of the linkage assembly 104* via a top pivot joint (e.g., the first transfer arm 19A* is coupled to a first transfer rod 21A* at its top pivot joint 114* and the second transfer arm 19B* is coupled to a second transfer rod 21B* at its top pivot joint 114*). Each transfer rod 21A*, 21B* is, in turn, coupled to a respective capture bar of the associated capture assembly 102*. For instance, as shown in FIG. 9, the first transfer rod 21A* is coupled to a first capture bar 13A* and the second transfer rod 21B* is coupled to a second capture bar 13B*.

However, unlike the embodiment of the linkage assembly 104 described above, the linkage assembly 104* incorporates a biasing member 85* (e.g., a spring) that is engaged with the bottom standoff 12*, thereby creating a spring-biased or spring-applied standoff. Specifically, as shown in FIG. 9, the biasing member 85* is installed between the bottom plate 16* and a washer or other engagement member 86* installed on the bottom standoff 12* such that the biasing member 85* applies a downward biasing force against the standoff 12*. As a result, the biasing member 85* may be configured to bias the linkage assembly 104* (and, thus, the associated capture assembly 102*) towards the closed position. Accordingly, the biasing member 85* may providing a supplemental locking force (in addition to the biasing devices 110* acting on the capture bars 13*) that ensure that the capture/linkage assemblies 102*, 104* are moved into the locked position as the pallet 100* is raised relative to its support surface.

It should be appreciated that the general function of the linkage assembly 104* is the same as the linkage assembly 104 described above and, thus, need not be described in detail. In general, when the bottom standoff 12* is actuated upwardly in the vertical direction (e.g., towards the top plate 17*), e.g., due to contact between the standoff 12* and the support surface (or a member supported relative to the support surface), the transfer lever 20* is similarly pushed or actuated upwardly, which results in the transfer arms 19A*, 19B* pivoting about their respective bottom pivot joints 112* to actuate the transfer rods 21A*, 21B* outwardly in the unlocking direction, which, in turn results in the capture bars 13* similarly being actuated in the unlocking direction to their unlocked position. Similarly, when the pallet 100* is lifted relative to the support surface such that the upward force on each bottom standoff 12* is removed, the biasing force applied by the biasing devices 110* (along with the biasing force provided by the basing member 85*) may function to actuate the capture assemblies 102* and associated linkage assemblies 104* back to the locked position.

Additionally, in several embodiments, the pallet 100* may also include one or more lock assemblies 90*, with each lock assembly 90* being configured to prevent unintended movement or actuation of one or more capture assemblies 102* toward the unlocked position. For instance, in the illustrated embodiment, the pallet 102* includes a pair of lock assemblies 90*, with each lock assembly 90* being configured to lock a pair of capture assemblies 102* into their respective locked positions. Specifically, as shown in FIGS. 7-9, each lock assembly 90* may be positioned between an adjacent pair of capture assemblies 102*.

Figure 10:
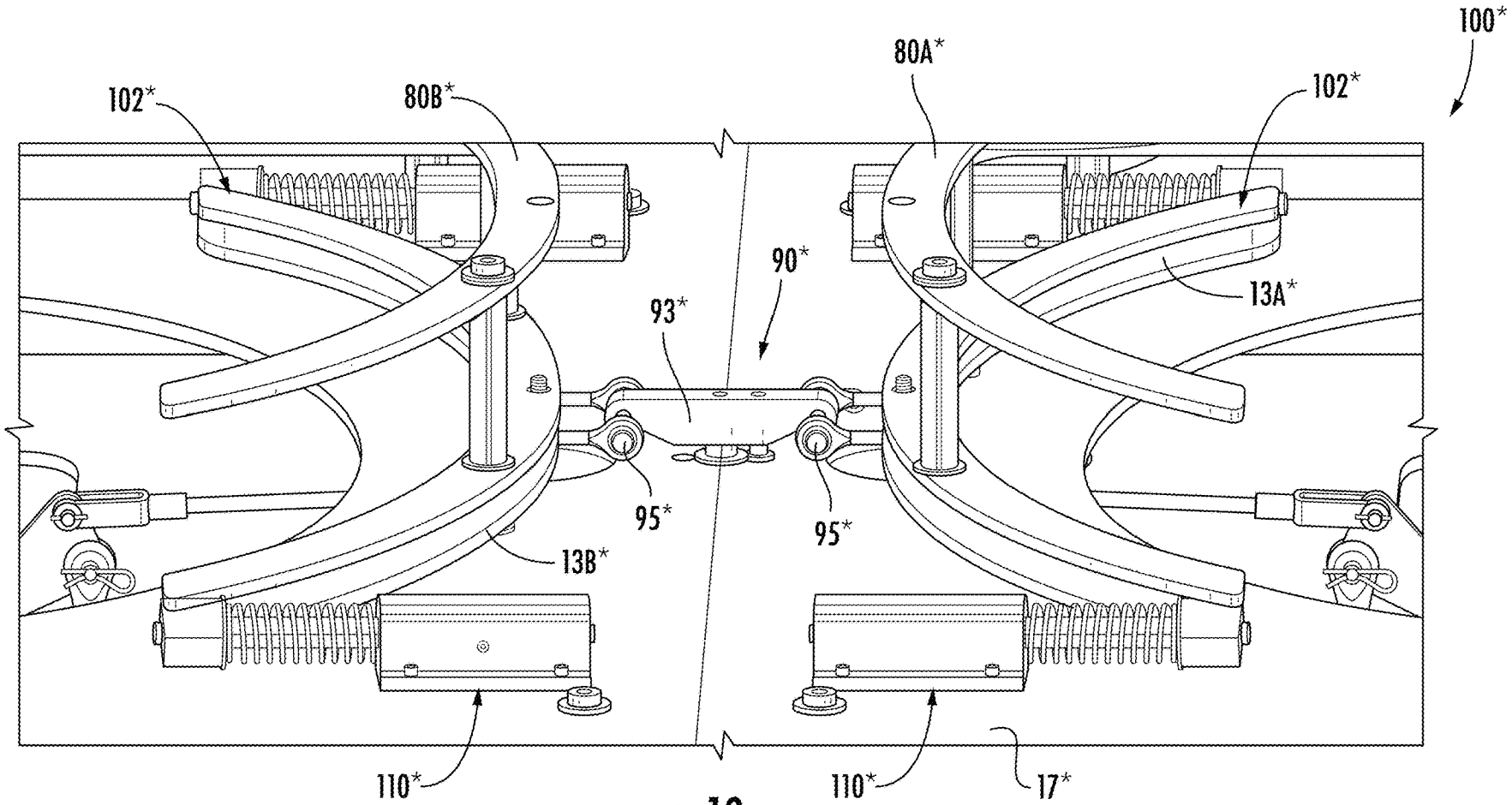
FIG. 10 illustrates a perspective view of a portion of the pallet shown in FIGS. 6-9, particularly illustrating a lock assembly of the pallet in an engage state relative to adjacent capture assemblies of the pallet.
Figure 11:
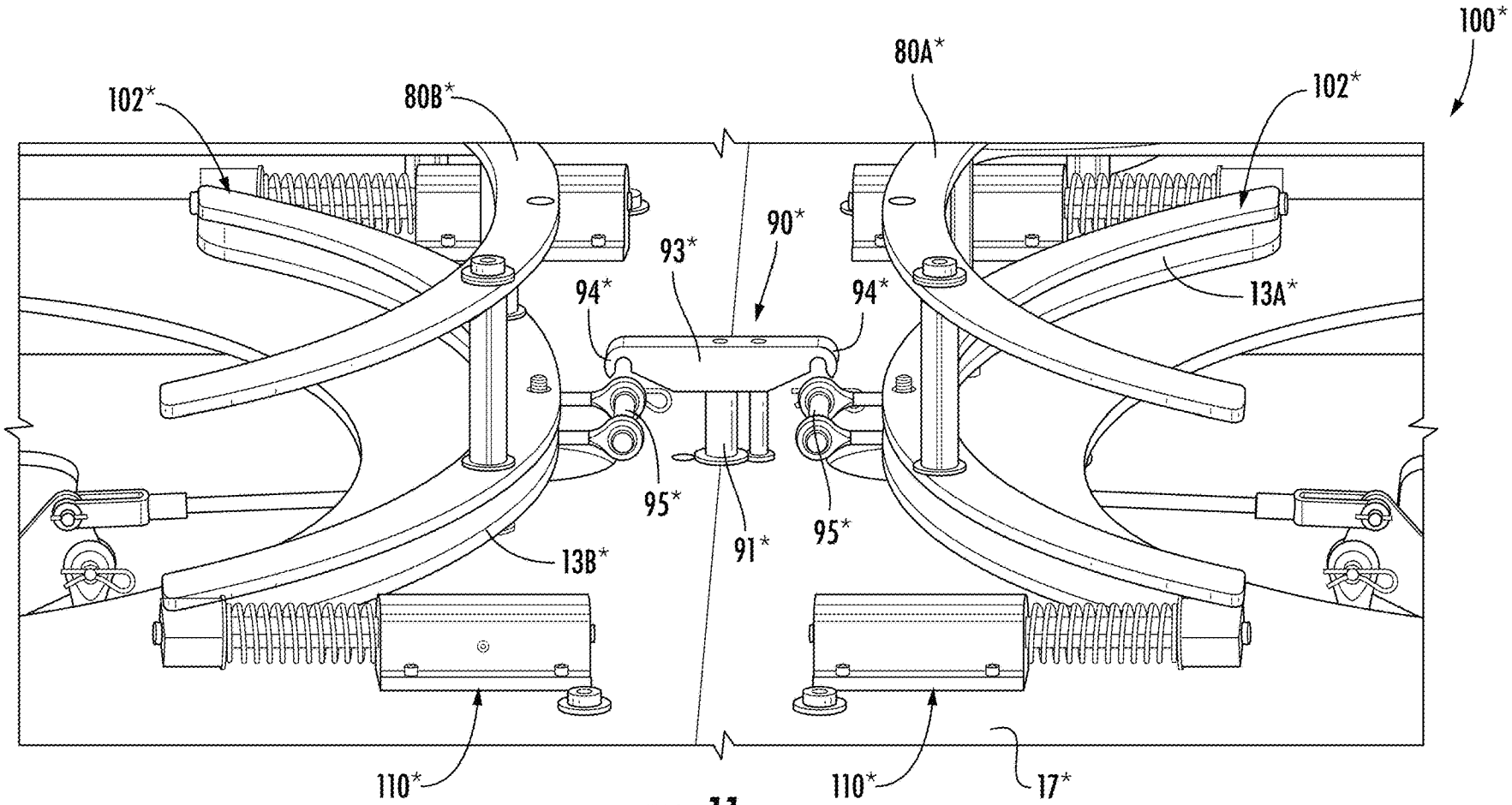
FIG. 11 illustrates a similar perspective view of the portion of the pallet shown in FIGS. 10, particularly illustrating the lock assembly of the pallet in a disengaged state relative to the adjacent capture assemblies of the pallet.

As particularly shown in FIG. 9, each lock assembly 90* includes a spring-biased locking standoff 91* (including the associated spring 92*) extending through the top and bottom plates 16*, 17* of the pallet 100*, with the spring 92* being configured to apply a downward biasing force against the standoff 91* to bias the lock assembly 90* into its engaged or locked position. Additionally, each lock assembly 90* includes a locking member 93* coupled to the top end of the standoff 91* and being positioned above the top plate 17* of the pallet 100* to allowing the locking member 93* to engage corresponding lock-related features of the adjacent capture assemblies 104*. For instance, FIGS. 10 and 11 illustrate partial, perspective views of the pallet 100* shown in FIGS. 6-9, particularly illustrating the locking member 93* in an engaged state (FIG. 10) and a disengaged state (FIG. 11) as the lock assembly 90* is moved between its locked and unlocked states, respectively. As shown in FIGS. 10 and 11, the locking member 93* includes hooked ends 94* that are configured to engage corresponding lock rods 95* coupled to and extending from the adjacent capture bar 13* of each associated capture assembly 102*. As such, when the locking member 93* is in its downward, engaged state (as shown in FIG. 10), the lock rods 95* of the adjacent capture assemblies 102* may be received within the hooked ends 94* of the locking member 93*, thereby preventing movement of the associated capture bars 13*. However, when the locking member 93* is actuated to its upward, disengaged state (e.g., as shown in FIG. 11), the hooked ends 94* of the locking member 93* may shift upwardly and clear the lock rods 95*, thereby allowing the capture assemblies 102* to shift outwardly to their unlocked position.

It should be appreciated that, similar to the standoffs 12* associated with the linkage assemblies 104*, the locking standoffs 91* may be actuated or shifted upwardly when the pallet 100* is placed onto a support surface (e.g., due to contact between the standoff 91* and the support surface or an adjacent support member), thereby allowing the locking member 93* to be moved to its disengaged state. Similarly, when the pallet 100* is lifted relative to the support surface such that the standoff 91* no longer contacts the support surface (or the adjacent support member), the spring 92* may function to bias the standoff 91* downwardly, thereby moving the locking member 93* downward towards its engaged state. In this regard, as particularly shown in FIG. 9, the locking standoffs 91* may, in one embodiment, extend downwardly relative to the bottom plate 16* to a lesser extent than the standoffs 12* of the linkage assembly 104*, thereby ensuring that the locking standoffs 91* disengage from the support surface (or adjacent support member) before the standoffs 12* as the pallet 100* is being lifted, thereby ensuring that the hooked ends 94* of the locking member 93* capture the lock rods 95* of the capture assemblies 102 as the associated capture bars 13* are being moved inwardly towards their locked positions.

It should be appreciated that, although not shown, the one or more embodiments of the disclose pallet may also include a manual adjustment device. For instance, a manual adjustment device may be positioned in mechanical communication with one or more components (e.g., a capture bar, a transfer arm, a transfer lever) of a pallet formed in accordance with the present disclosure. The manual adjustment device may permit a user or operator to change or move a capture assembly from a locked position to an unlocked position and/or from an unlocked position to a locked position. In this respect, in one aspect, a user or operator may change or move a capture assembly from a locked position to an unlocked position and/or from an unlocked position to a locked position without the actuation of a standoff and/or transfer lever via interaction with a support surface or a support member. For instance, a user or operator may change or move a capture assembly from a locked position to an unlocked position and/or from an unlocked position to a locked position by actuating a standoff via the manual adjustment device. Notably, a user or operator may change or move a capture assembly from a locked position to an unlocked position and/or from an unlocked position to a locked position by pushing, pulling, and/or rotating a manual adjustment device.

In this regard, a manual adjustment device may be configured to lock and/or affix one or more pallet objects to a set position on a pallet and may be configured to unlock and/or release one or more pallet objects to a set position on a pallet. In one aspect, a different manual adjustment device may be utilized for each capture assembly and corresponding linkage assembly respectively. In this respect, each capture assembly and corresponding linkage assembly may have a corresponding manual adjustment device to unlock and/or lock a pallet object. In another aspect, one manual adjustment device may be utilized for two or more (e.g., all) capture assemblies and corresponding linkage assemblies simultaneously. In this respect, two or more capture assemblies and their corresponding linkage assemblies may have a corresponding manual adjustment device to unlock and/or lock two or more pallet objects.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

The invention claimed is:

1. A pallet comprising:

a plate configured to support a pallet object relative to a support surface;

a capture assembly supported relative to the plate and being configured to selectively engage and disengage the pallet object, the capture assembly comprising:

one or more capture bars movable between an unlocked position and a locked position, each capture bar of the one or more capture bars configured to be engaged with a portion of the pallet object when in the locked position and disengaged from said portion of the pallet object when in the unlocked position;

wherein each capture bar of the one or more capture bars is configured to be automatically actuated to the unlocked position with movement of the pallet towards the support surface and automatically actuated to the locked position with movement of the pallet away from the support surface.

2. The pallet of claim 1, wherein the one or more capture bars comprises first and second capture bars, the first and second capture bars configured to be engaged with separate portions of an outer perimeter of the pallet object when in the locked position.

3. The pallet of claim 2, wherein the first and second capture bars are configured to engage the pallet object along opposed sides of the pallet object.

4. The pallet of claim 2, wherein the first capture bar is an upper capture bar and the second capture bar is a lower capture bar, wherein the upper and lower capture bars are configured to engage the pallet object along a same side of the pallet object.

5. The pallet of claim 1, further comprising a linkage assembly provided in operative association with the capture assembly, the linkage assembly being configured to automatically actuate each capture bar of the one or more capture bars to the unlocked position with movement of the pallet towards the support surface.

6. The pallet of claim 5, wherein a portion of the linkage assembly is configured to contact the support surface or a member supported relative to the support surface as the pallet is moved towards the support surface such that the contact results in each capture bar of the one or more capture bars being automatically actuated to the unlocked position.

7. The pallet of claim 6, wherein the portion of the linkage assembly comprises a standoff configured to contact the support surface or the member supported relative to the support surface, the standoff being coupled to each capture bar of the one or more capture bars via one or more components of the linkage assembly such that movement of the standoff relative to the plate of the pallet results in each capture bar of the one or more capture bars being automatically actuated to the unlocked position.

8. The pallet of claim 7, wherein a biasing member is provided in operative association with the standoff, the biasing member being configured to apply a biasing force against the standoff that biases each capture bar of the one or more capture bars towards the unlocked position.

9. The pallet of claim 8, wherein upward movement of the standoff relative to the plate results in each capture bar of the one or more capture bars being automatically actuated to the unlocked position, the biasing member being configured to apply a downwardly directed basing force against the standoff.

10. The pallet of claim 5, further comprising a biasing device provided in operative association with the capture assembly separate from the linkage assembly, the biasing device being configured to bias each capture bar of the one or more capture bars towards the locked position.

11. The pallet of claim 1, further comprising a biasing device coupled to each capture bar of the one or more capture bars, the biasing device being configured to bias each capture bar of the one or more capture bars towards the locked position.

12. The pallet of claim 1, further comprising a lock assembly configured to engage a lock rod extending from each of the one or more capture bars of the capture assembly to maintain each capture bar of the one or more capture bars in the locked position.

13. The pallet of claim 12, wherein the lock assembly comprises a lock mechanism configured to be moved relative to each lock rod of each of the one or more capture bars between an engaged state and a disengaged state.

14. The pallet of claim 13, wherein the lock mechanism is configured to be automatically moved toward the disengaged state with movement of the pallet towards the support surface and automatically moved towards the engaged state with movement of the pallet away from the support surface.

15. A method for securing pallet objects relative to a pallet, the pallet including a plate configured to support a pallet object relative to a support surface, the pallet further including a capture assembly supported relative to the plate and being configured to selectively engage and disengage the pallet object, the capture assembly including one or more capture bars movable between an unlocked position and a locked position, the method comprising:

positioning the pallet object onto the plate relative to the capture assembly while the pallet is supported by the support surface and the one or more capture bars are in the unlocked position; and raising the pallet relative to the support surface such that the capture bars are automatically moved to the locked position and engage with a portion of the pallet object.

16. The method of claim 15, further comprising, subsequent to raising the pallet relative to the support surface, lowering the pallet relative to the support surface such that the one or more capture bars are automatically moved to the unlocked position and disengage with the portion of the pallet object.

17. The method of claim 16, wherein the pallet further comprises a linkage assembly provided in operative association with the capture assembly, a portion of the linkage assembly being configured to contact the support surface or a member supported relative to the support surface when the pallet is supported by the support surface, wherein lowering the pallet relative to the support surface comprises lowering the pallet relative to the support surface such that the portion of the linkage assembly contacts the support surface or the member supported relative to the support surface such that the linkage assembly automatically actuates the one or more capture bars to the unlocked position.

18. The method of claim 17, wherein the pallet further comprises a biasing device provided in operative association with the capture assembly separate from the linkage assembly, the biasing device being configured to bias the one or more capture bars towards the locked position, wherein raising the pallet relative to the support surface comprises raising the pallet relative to the support surface such that the portion of the linkage assembly no longer contacts the support surface or the member supported relative to the support surface and the biasing device biases the one or more capture bars into the locked position.

19. The method of claim 15, wherein the one or more capture bars comprises first and second capture bars, wherein positioning the pallet object onto the plate relative to the capture assembly comprises positioning the pallet object into the plate such that the first and second capture bars are positioned along opposed sides of an outer perimeter of the pallet object, the capture bars being configured to engage separate portions of the outer perimeter of the pallet object when moved to the locked position.

20. The method of claim 15, wherein the pallet further comprises a lock assembly configured to engage a lock rod extending from each of the one or more capture bars of the of the capture assembly to maintain the one or more capture bars in the locked position, wherein raising the pallet relative to the support surface further comprises raising the pallet relative to the support surface such that a lock mechanism of the lock assembly is automatically moved to an engaged state with each lock rod of the one or more capture bars to maintain the one or more capture bars in the locked position.

21. A pallet comprising:

a plate configured to support a pallet object relative to a support surface;

a capture assembly supported relative to the plate and being configured to selectively engage and disengage the pallet object, the capture assembly comprising:

one or more capture bars movable between an unlocked position and a locked position, each capture bar of the one or more capture bars configured to be engaged with a portion of the pallet object when in the locked position and disengaged from said portion of the pallet object when in the unlocked position; and a linkage assembly provided in operative association with the capture assembly, the linkage assembly being configured to actuate each capture bar of the one or more capture bars to the unlocked position with movement of the pallet towards the support surface, wherein a portion of the linkage assembly is configured to contact the support surface or a member supported relative to the support surface as the pallet is moved towards the support surface such that the contact results in each capture bar of the one or more capture bars being actuated to the unlocked position;

wherein each capture bar of the one or more capture bars is configured to be actuated to the unlocked position with movement of the pallet towards the support surface and actuated to the locked position with movement of the pallet away from the support surface.

22. The pallet of claim 21, wherein the portion of the linkage assembly comprises a standoff configured to contact the support surface or the member supported relative to the support surface, the standoff being coupled to each capture bar of the one or more capture bars via one or more components of the linkage assembly such that movement of the standoff relative to the plate of the pallet results in each capture bar of the one or more capture bars being actuated to the unlocked position.

23. The pallet of claim 22, wherein a biasing member is provided in operative association with the standoff, the biasing member being configured to apply a biasing force against the standoff that biases each capture bar of the one or more capture bars towards the unlocked position.

24. The pallet of claim 23, wherein upward movement of the standoff relative to the plate results in each capture bar of the one or more capture bars being actuated to the unlocked position, the biasing member being configured to apply a downwardly directed basing force against the standoff.

* * * * *